US007287501B2

(12) United States Patent
Yamada

(10) Patent No.: US 7,287,501 B2
(45) Date of Patent: Oct. 30, 2007

(54) CONTROL DEVICE OF INTERNAL COMBUSTION ENGINE

(75) Inventor: Kazumi Yamada, Toyota (JP)

(73) Assignee: Toyota Jidosha Kabushiki Kaisha, Toyota (JP)

( * ) Notice: Subject to any disclaimer, the term of this patent is extended or adjusted under 35 U.S.C. 154(b) by 0 days.

(21) Appl. No.: 11/287,313

(22) Filed: Nov. 28, 2005

(65) Prior Publication Data

US 2006/0118075 A1 Jun. 8, 2006

(30) Foreign Application Priority Data

Dec. 8, 2004 (JP) ..... 2004-354800

(51) Int. Cl.
*F02N 17/00* (2006.01)
*F02M 63/02* (2006.01)
*F02D 17/00* (2006.01)

(52) U.S. Cl. ..... 123/179.4; 123/198 DB; 123/198 DC

(58) Field of Classification Search ..... 123/179.4, 123/198 DB, 198 D, 198 DC, 632; 701/112
See application file for complete search history.

(56) References Cited

U.S. PATENT DOCUMENTS 3,241,539 A * 3/1966 Kuehn, III ..... 123/198 DC
4,330,782 A * 5/1982 Hashimoto et al. ..... 343/715
4,331,880 A * 5/1982 Dittman et al. ..... 290/38 R
4,414,937 A * 11/1983 Ueda et al. ..... 123/198 D
4,466,392 A * 8/1984 Uchida et al. ..... 123/179.4
4,768,480 A * 9/1988 Grenn et al. ..... 123/198 D
5,072,703 A * 12/1991 Sutton ..... 123/179.4
5,179,920 A * 1/1993 Bender ..... 123/198 DB
5,377,641 A * 1/1995 Salazar ..... 123/179.4
5,670,831 A * 9/1997 Georgiades ..... 307/10.3
6,075,459 A * 6/2000 Saarem et al. ..... 340/825.69
6,371,074 B1 * 4/2002 Keller ..... 123/198 DB
6,604,502 B1 8/2003 Bisaro et al.
7,085,646 B2 * 8/2006 Tanaka et al. ..... 701/113
7,143,732 B2 * 12/2006 Watanabe et al. ..... 123/179.4
2002/0165659 A1 11/2002 Boggs et al.
2002/0165660 A1 11/2002 Boggs et al.
2003/0163243 A1 8/2003 Inoue

FOREIGN PATENT DOCUMENTS

DE 103 00 178 A1 7/2004
EP 1 193 386 A2 4/2002
JP A 63-34241 2/1988
JP A 3-78563 4/1991
JP A 6-137197 5/1994
JP A 11-107794 4/1999
JP A 2000-87770 3/2000
JP A 2000-104651 4/2000

OTHER PUBLICATIONS

"Turbo timer." Wikipedia, The Free Encyclopedia. Jan. 3, 2007, 20:24 UTC. Wikimedia Foundation, Inc. Jan. 9, 2007 <http://en.wikipedia.org/w/index.php?title=Turbo_timer&oldid=98246119>.*
Seeley, Jeff. "Information on Turbo timers." Nov. 13, 1996. International MR2 Owerns Club. Jan. 9, 2007.□□<http://www.mr2.com/TEXT/TurboTimers.html>.*

* cited by examiner

*Primary Examiner*—Stephen K. Cronin
*Assistant Examiner*—Ka Chun Leung
(74) *Attorney, Agent, or Firm*—Oliff & Berridge PLC

(57) ABSTRACT

A coil driving a contact of an ignition and injection relay is connected to a connection line of a main relay and an ECU. When an ignition switch is turned off, the ECU drives an ignition device and an injection device for a prescribed period thereafter. Then, the ECU turns off a main relay to perform self-shutting-off, and the ignition and injection relay is turned off interlocked with an operation of the main relay being turned off.

5 Claims, 3 Drawing Sheets

CONTROL DEVICE OF INTERNAL COMBUSTION ENGINE

This nonprovisional application is based on Japanese Patent Application No. 2004-354800 filed with the Japan Patent Office on Dec. 8, 2004, the entire contents of which are hereby incorporated by reference.

BACKGROUND OF THE INVENTION

1. Field of the Invention

The present invention relates to a control device of an internal combustion engine. More specifically, the present invention relates to a control device performing stop control for operating an internal combustion engine for a prescribed period after an ignition switch is turned off.

2. Description of the Background Art

Japanese Patent Laying-Open No. 2000-104651 discloses an ignition device for operating an engine for a certain time after an ignition switch is turned off. The ignition device includes an engine control unit (hereafter referred to as an "ECU") for controlling ignition of a spark plug and fuel injection, an ignition switch, an ECU relay for supplying/cutting off operating power to the ECU, an ignition coil, a spark plug, and an ignition coil relay. The ignition switch and the ECU relay are provided in parallel between a battery power supply and the ECU. The ignition coil relay is provided between the battery power supply and the ignition coil, and receives an operation instruction from the ECU.

In the ignition device, power is supplied to the ignition coil via the ignition coil relay controlled by the ECU. When ignition by the spark plug is performed for a predetermined number of times after turning-off of the ignition switch, the ignition coil relay is turned off by the ECU.

According to the ignition device, since ignition of the spark plug is performed for a predetermined number of times after the ignition switch is turned off, operability and exhaust properties at restarting of the engine can be prevented from being deteriorated due to injected fuel which remains inside a cylinder of the engine without attaining combustion.

When an engine is stopped, there is a desire to operate the engine for a certain period after a driver turns off an ignition switch in order to set an actuator which operates using an engine oil pressure (for example, an intake and exhaust valve controlled with a VVT (Variable Valve Timing)) to a prescribed position for the next starting of the engine.

The ignition device disclosed in Japanese Patent Laying-Open No. 2000-104651 described above, in which ignition by the spark plug is performed for a predetermined number of times after the ignition switch is turned off and then the ignition coil relay is turned off by the ECU, can satisfy the desire. In the ignition device, however, since the ignition coil relay is driven by the ECU, a circuit for driving the ignition coil relay must be added to the ECU. Therefore, the ignition device increases a cost and also decreases reliability of the ECU.

SUMMARY OF THE INVENTION

The present invention is made to solve the above-described problem. An object of the present invention is to provide a control device of an internal combustion engine which attains stop control for operating the internal combustion engine for a prescribed period after an ignition switch is turned off without adding a circuit to an ECU.

According to the present invention, a control device of an internal combustion engine includes a control portion performing stop control for operating the internal combustion engine for a prescribed period after an ignition switch is turned off, a first relay which is turned off after performance of the stop control, and a second relay receiving an output of the first relay and interlocked with an operation of the first relay being turned off to cut off feeding to at least one of an ignition device and an injection device of the internal combustion engine.

Preferably, the first relay includes a main relay supplying and cutting off power to the control portion, and the main relay is turned off by the control portion after performance of the stop control by the control portion.

A drive wire for driving the second relay is preferably connected to a feeding line from the main relay to the control portion.

Preferably, the control device of an internal combustion engine further includes a third relay supplying and cutting off power to an electric pump supplying fuel to the internal combustion engine.

The third relay is preferably interlocked with an operation of the ignition switch being turned off to cut off feeding to the electric pump.

The prescribed period is preferably defined with a prescribed time, regardless of a number of ignition performance of the ignition device.

In the control device of an internal combustion engine according to the present invention, the control portion performs stop control for operating the internal combustion engine for a prescribed period after the ignition switch is turned off. In addition, the second relay receives an output of the first relay which is turned off after performance of the stop control, and is interlocked with an operation of the first relay being turned off to cut off feeding to the ignition device and/or the injection device of the internal combustion engine. Therefore, outputting of a control signal from the control portion to the second relay is not required to turn off the second relay after the stop control is completed.

Therefore, according to the present invention, a circuit for turning off the second relay is not required to be additionally provided in the control portion. As a result, the stop control by the control device can be implemented at a low cost. In addition, reliability of the control portion is not decreased. Furthermore, since feeding from a power supply to the injection device can also be cut off interlocked with the operation of the first relay being turned off, operations of the injection device together with the ignition device can be reliably stopped after performance of the stop control by the control portion.

In addition, the control device of an internal combustion engine according to the present invention further includes the third relay supplying and cutting off power to the electric pump supplying fuel to the internal combustion engine. That is, since the third relay cutting off feeding to the electric pump is separately provided besides the second relay cutting off feeding to the ignition device and/or the injection device, even when welding of the second relay or a failure of the control portion occurs, the internal combustion engine is stopped by stopping of fuel supply to the injection device. Therefore, safety in terms of fail-safe becomes higher according to the present invention.

In addition, in the control device of an internal combustion engine according to the present invention, the prescribed period for operating the ignition device and/or the injection device after turning-off of the ignition switch is defined with an operation time, not with a number of ignition performance of the ignition device. Therefore, the internal combustion engine always stops after a constant time from turning-off of the ignition switch regardless of a rotation number of the internal combustion engine, which can suppress generation of uneasy feeling of a user caused by variations in times from turning-off of the ignition switch to stopping of the internal combustion engine.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

Figure 1:
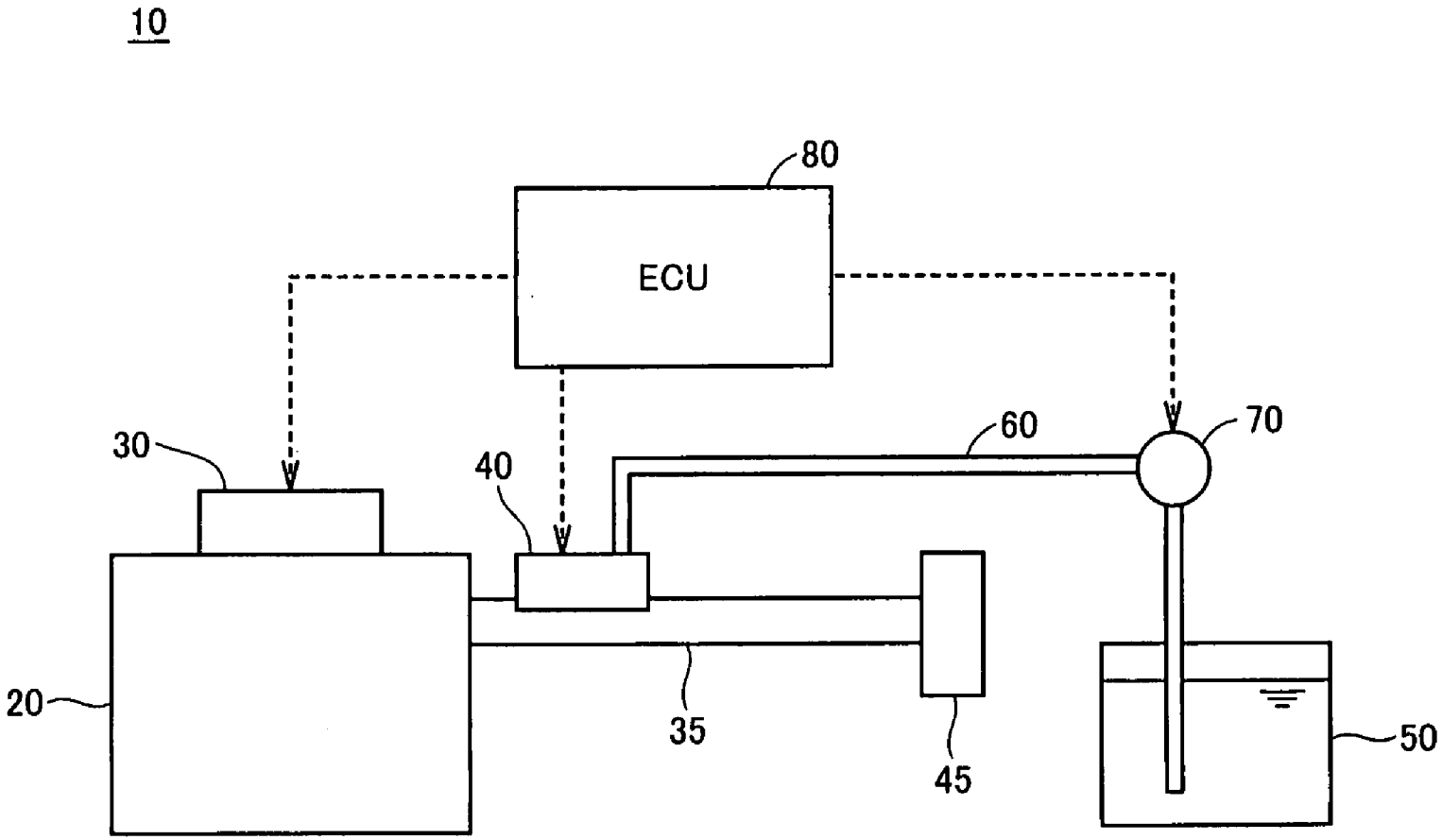
FIG. 1 shows a whole construction of an engine system controlled by a control device according to an embodiment of the present invention.

An embodiment of the present invention will now be described in detail referring to the drawings. It is to be noted that, the same or corresponding portions in the drawings are indicated with the same characters and descriptions thereof will not be repeated.

FIG. 1 shows a whole construction of an engine system controlled by a control device according to the embodiment of the present invention. Referring to FIG. 1, an engine system 10 includes an engine 20, an ignition device 30, an intake duct 35, an injection device 40, an air cleaner 45, a fuel tank 50, a delivery pipe 60, a fuel pump 70, and an ECU 80.

Engine 20 generates mechanical power of a vehicle on which this engine system 10 is mounted. Ignition device 30 includes an ignitor for generating a high voltage and a spark plug for generating a spark using the high voltage from the ignitor (both are not shown), and causes ignition based on a control instruction from ECU 80 to burn a mixture inside a cylinder of engine 20.

Injection device 40 includes an injector injecting particles of fuel, and injects fuel supplied from delivery pipe 60 into air supplied from intake duct 35 to engine 20 based on a control instruction from ECU 80. With this, a mixture of air and fuel is generated, and the generated mixture is supplied into the cylinder of engine 20.

Intake duct 35 is an intake pipe for supplying air to engine 20. Air cleaner 45 is connected to intake duct 35 and removes a contaminant included in air supplied via intake duct 35 to engine 20. Fuel tank 50 is a tank for storing fuel, and delivery pipe 60 is a fuel supply pipe for supplying fuel inside fuel tank 50 to injection device 40. Fuel pump 70 is formed with an electric pump and provided on delivery pipe 60. Fuel pump 70 operates based on an operation instruction from ECU 80, and supplies fuel inside fuel tank 50 to injection device 40 via delivery pipe 60.

ECU 80 controls operations of ignition device 30, injection device 40 and fuel pump 70 based on an engine load or a rotation speed, and operates engine 20 with a desired rotation number. In addition, when engine 20 is stopped, ECU 80 performs stop control for operating ignition device 30 and injection device 40 for a prescribed period after an ignition switch is turned off. This will be described below in detail.

In this engine system 10, a mixture of air supplied from intake duct 35 and fuel supplied from fuel tank 50 is generated by injection device 40, and the mixture is supplied to engine 20. Then, ignition device 30 causes ignition in a prescribed timing based on the control instruction from ECU 80 to burn the mixture supplied to engine 20.

Figure 2:
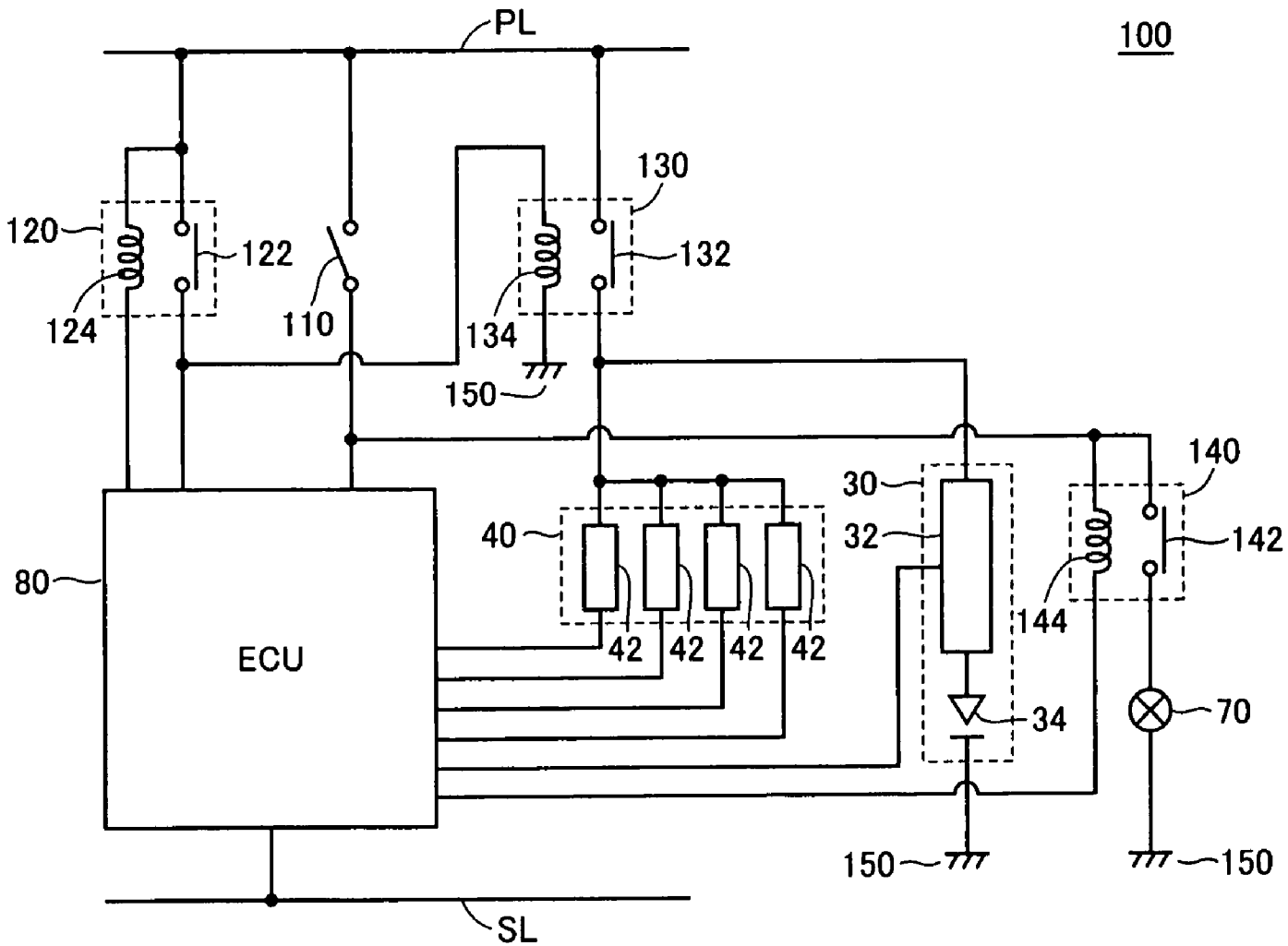
FIG. 2 is a functional block diagram of the control device controlling the engine system shown in FIG. 1.

FIG. 2 is a functional block diagram of the control device controlling engine system 10 shown in FIG. 1. Referring to FIG. 2, a control device 100 includes an ignition switch 110, a main relay 120, an ignition and injection relay 130, ignition device 30, injection device 40, a pump drive relay 140, fuel pump 70, ECU 80, a power supply line PL, and a ground line SL.

Power supply line PL is connected to a positive electrode terminal of a battery (not shown, which is the same in the following), and ground line SL is connected to a negative electrode terminal of the battery.

Ignition switch 110 is provided between power supply line PL and ECU 80, and operated by a driver of the vehicle. Main relay 120 is provided between power supply line PL and ECU 80, and supplies/cuts off power from power supply line PL to ECU 80. Main relay 120 includes a contact 122 and a coil 124, and performs an on/off operation using magnetic force generated in coil 124 when a current flows through coil 124. That is, main relay 120 is turned on when a current flows through coil 124, and is turned off when a current does not flow through coil 124.

Ignition and injection relay 130 is provided between power supply line PL and ignition and injection devices 30 and 40, and supplies/cuts off power from power supply line PL to ignition device 30 and injection device 40. Ignition and injection relay 130 includes a contact 132 and a coil 134, and performs an on/off operation using magnetic force generated in coil 134 when a current flows through coil 134. Coil 134 has one end connected to a line connecting contact 122 of main relay 120 with ECU 80, and the other end connected to a ground node 150.

Ignition and injection relay 130 is driven by an output from main relay 120. That is, when main relay 120 is turned on, a current flows from main relay 120 into coil 134 of ignition and injection relay 130 to turn on ignition and injection relay 130. In addition, when main relay 120 is turned off, ignition and injection relay 130 is turned off because a current does not flow from main relay 120 to coil 134.

Ignition device 30 receives supply of operating power from power supply line PL via ignition and injection relay 130. Ignition device 30 includes an ignitor 32 and a spark plug 34. Ignitor 32 operates based on a control instruction from ECU 80 and boosts a voltage which is received from power supply line PL via ignition and injection relay 130. Spark plug 34 uses a boosted voltage boosted by ignitor 32 to generate a spark for firing the mixture.

Injection device 40 receives supply of operating power from power supply line PL via ignition and injection relay 130. Injection device 40 includes injectors 42 for respective cylinders of the engine. Each injector 42 operates based on a control instruction from ECU 80, and injects particles of fuel supplied from fuel pump 70.

Pump drive relay 140 is provided between ignition switch 110 and fuel pump 70, and supplies/cuts off power from power supply line PL to fuel pump 70. Pump drive relay 140 includes a contact 142 and a coil 144, and performs an on/off operation using magnetic force generated in coil 144 when a current flows through coil 144. Coil 144 has one end connected to ignition switch 110 and the other end connected to ECU 80.

Pump drive relay 140 can operate when ignition switch 110 is turned on, and is driven by ECU 80 when ignition switch 110 is turned on. When ignition switch 110 is turned off, pump drive relay 140 is also turned off in synchronization therewith.

Fuel pump 70, which is an electric pump, receives supply of operating power from power supply line PL via ignition switch 110 and pump drive relay 140 which are connected in series. When pump drive relay 140 is turned on based on an operation instruction from ECU 80, fuel pump 70 receives supply of power from pump drive relay 140 and operates to supply fuel inside fuel tank 50 to injection device 40.

ECU 80 determines an ignition timing of ignition device 30 and an injection timing of injection device 40 based on a condition such as a load of the engine or a rotation speed, and outputs control instructions corresponding to the ignition timing and the injection timing determined to respective ignition device 30 and injection device 40 to control driving of ignition device 30 and injection device 40. ECU 80 also outputs an operation instruction to pump drive relay 140 to drive fuel pump 70.

When ignition switch 110 is turned off by the driver of the vehicle, ECU 80 further performs stop control of engine 20. The stop control is to operate engine 20 for a prescribed period after ignition switch 110 is turned off in order to set an actuator which operates with an engine oil pressure (such as an intake and exhaust valve controlled with a VVT) to a prescribed position for the next starting of the engine.

That is, when ignition switch 110 is turned off, ECU 80 further continues driving of ignition device 30 and injection device 40 for a predetermined prescribed time. After a lapse of the prescribed time, ECU 80 stops ignition device 30 and injection device 40 and stops feeding to coil 124 of main relay 120. With this, main relay 120 is turned off and feeding from power supply line PL to ECU 80 is cut off. That is, ECU 80 cuts off feeding from power supply line PL by itself A first characteristic of a construction of control device 100 is that, ignition and injection relay 130 is driven with an output from main relay 120. With this, ignition and injection relay 130 is turned off interlocked with an operation of main relay 120 being turned off after ignition switch 110 is turned off and stop control of the engine by ECU 80 is completed, and therefore ECU 80 does not have to output a turning-off instruction for ignition and injection relay 130. Therefore, it is not necessary to provide an additional circuit in ECU 80 for implementing the stop control of the engine. It is to be noted that, stopping of ignition device 30 and injection device 40 after the stop control of the engine, that is, stopping of the engine is performed by ECU 80.

A second characteristic of the construction of control device 100 is that, a relay is also interposed between power supply line PL and injection device 40. That is, injection device 40 is connected to ignition and injection relay 130. With this, though an operation of injection device 40 is stopped by ECU 80 after the stop control of the engine, since main relay 120 is thereafter turned off and thereby ignition and injection relay 130 is turned off, injection device 40 can be reliably stopped. In addition, since control device 100 has a construction in which injection device 40 is connected to ignition and injection relay 130 in common with ignition device 30, a separate relay for injection device 40 is not required to be provided.

A third characteristic of the construction of control device 100 is that, a power supply route to fuel pump 70 is separate from a power supply route to injection device 40. That is, fuel pump 70 is not connected to ignition and injection relay 130 together with injection device 40 but connected to pump drive relay 140, and pump drive relay 140 is connected to power supply line PL via ignition switch 110. With this, since fuel corresponding to a residual pressure in delivery pipe 60 (not shown) is only supplied to injection device 40 after ignition switch 110 is turned off, the engine is stopped when the fuel in delivery pipe 60 (not shown) attains combustion even when welding of ignition and injection relay 130 or a failure of ECU 80 occurs.

In control device 100, when ignition switch 110 is turned off, pump drive relay 140 is correspondingly turned off and fuel pump 70 is stopped. Then, ECU 80 performs the stop control of engine 20 to further drive ignition device 30 and injection device 40 for a prescribed time. Though fuel pump 70 is already stopped during the stop control of engine 20, fuel corresponding to a residual pressure in delivery pipe 60 is supplied to injection device 40, as described above.

After a lapse of the prescribed time, ECU 80 stops operations of ignition device 30 and injection device 40 and stops feeding to coil 124 of main relay 120. With this, main relay 120 is turned off and ECU 80 performs self-shutting-off. Then, ignition and injection relay 130 is turned off interlocked with turning-off of main relay 120, and feeding from power supply line PL to ignition device 30 and injection device 40 is cut off.

Figure 3:
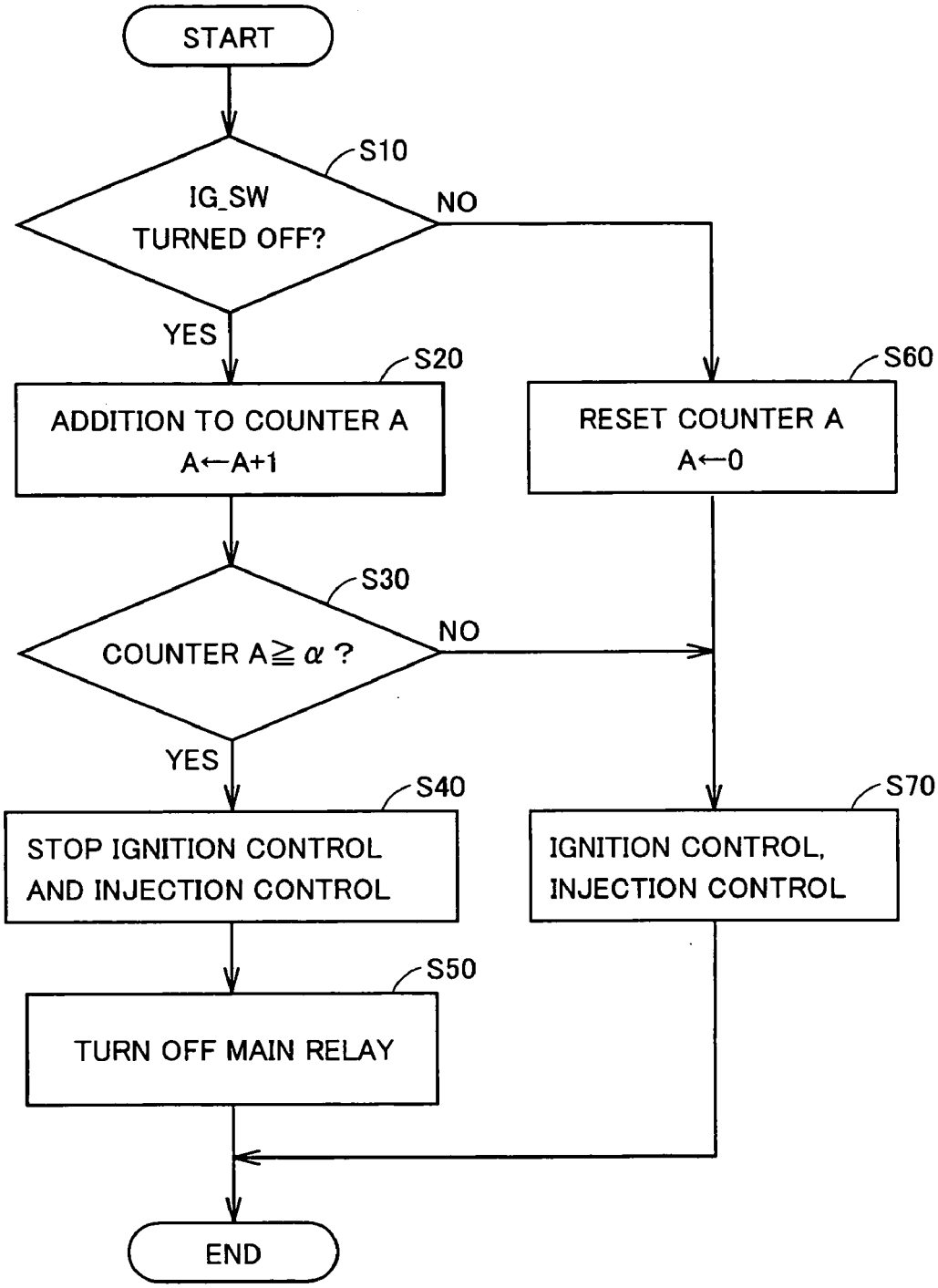
FIG. 3 is a flow chart of engine stop control performed by an ECU shown in FIG. 2.

FIG. 3 is a flow chart of the stop control of engine 20 performed by ECU 80 shown in FIG. 2. Processing according to the flow chart is performed in a predetermined cycle. Referring to FIG. 3, ECU 80 determines as to whether ignition switch 110 is turned off or not based on a potential of a connection line to ignition switch 110 (step S10). When it is determined that ignition switch 110 is not turned off (NO in step S10), ECU 80 resets a counter A to 0 (step S60). Counter A is a counter for measuring a performance time of the stop control of engine 20. When counter A is reset to 0, ECU 80 moves the processing to step S70.

On the other hand, when it is determined that ignition switch 110 is turned off in step S10 (YES in step S10), ECU 80 performs addition to counter A to measure a time elapsed from turning-off of ignition switch 110 (step S20). When ignition switch 110 is turned off, fuel pump 70 is stopped.

When addition to counter A is performed, ECU 80 determines as to whether or not counter A is at least a value $\alpha$ which corresponds to a predetermined prescribed time (step S30). When it is determined that counter A is at least $\alpha$ (YES in step S30), ECU 80 stops outputting of control instructions to ignition device 30 and injection device 40 to stop ignition control by ignition device 30 and injection control by injection device 40 (step S40). Thereafter, ECU 80 turns off main relay 120 and performs self-shutting-off (step S50) to end a series of processing. As described above, when main relay 120 is turned off, ignition and injection relay 130 is turned off and feeding from power supply line PL to ignition device 30 and injection device 40 is cut off.

On the other hand, when it is determined that counter A is smaller than $\alpha$ in step S30 (NO in step S30), ECU 80 determines that the prescribed time has not been elapsed from turning-off of ignition switch 110, and continuously performs ignition control by ignition device 30 and injection control by injection device 40 (step S70).

As described above, according to control device 100 in this embodiment, the stop control for operating engine 20 for a prescribed period is performed after ignition switch 110 is turned off. In control device 100, since ignition and injection relay 130 for cutting off feeding to ignition device 30 and injection device 40 is driven with an output from main relay 120, a circuit for turning off ignition and injection relay 130 after the prescribed period from turning-off of ignition switch 110 is not required to be additionally provided in ECU 80. Therefore, the stop control of engine 20 can be implemented at a low cost. In addition, reliability of ECU 80 is not decreased because a circuit is not added to ECU 80.

According to control device 100, since feeding to injection device 40 is also performed via ignition and injection relay 130, driving of injection device 40 can be reliably stopped. In addition, since injection device 40 is connected to the relay (ignition and injection relay 130) to which ignition device 30 is connected, a relay for injection device 40 is not required to be separately provided.

Furthermore, fuel pump 70 is connected to pump drive relay 140 rather than ignition and injection relay 130, and pump drive relay 140 is connected to power supply line PL via ignition switch 110. That is, a power supply route to fuel pump 70 is separate from a power supply route to injection device 40. Therefore, safety in terms of fail-safe becomes higher.

Furthermore, since the period for operating engine 20 after turning-off of ignition switch 110 is defined with an operation time, not with a number of ignition performance of the ignition coil, engine 20 always stops after a constant time from turning-off of ignition switch 110 regardless of a rotation number of engine 20. Therefore, a user does not feel uneasy because of variations in times from turning-off of ignition switch 110 to stopping of engine 20.

It is to be noted that, though ignition and injection relay 130 described above is shared between ignition device 30 and injection device 40, the present invention is not limited to a construction as such, and relays for ignition device 30 and injection device 40 may be separately provided.

In addition, though the period for operating engine 20 after turning-off of ignition switch 110 is defined with an operation time rather than a number of ignition performance of the ignition coil in the description above, the present invention is not limited thereto, and an operation period of engine 20 during the stop control may be defined with a number of ignition performance.

It is to be noted that, in the description above, ECU 80 corresponds to a "control portion" in the present invention, and main relay 120 corresponds to a "first relay" in the present invention. In addition, ignition and injection relay 130 corresponds to a "second relay" in the present invention, and pump drive relay 140 corresponds to a "third relay" in the present invention.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A control device of an internal combustion engine, comprising:

a control portion performing stop control for operating the internal combustion engine for a prescribed period after an ignition switch is turned off;

a first relay that is a main relay supplying and cutting off power to said control portion, and wherein the first relay is turned off by said control portion after performance of said stop control by said control portion; and a second relay receiving an output of said first relay and interlocked with an operation of said first relay being turned off to cut off feeding to at least one of an ignition device and an injection device of said internal combustion engine.

2. The control device of an internal combustion engine according to claim 1, wherein a drive wire for driving said second relay is connected to a feeding line from said first relay to said control portion.

3. The control device of an internal combustion engine according to claim 1, further comprising a third relay supplying and cutting off power to an electric pump supplying fuel to said internal combustion engine.

4. The control device of an internal combustion engine according to claim 3, wherein said third relay is interlocked with an operation of said ignition switch being turned off to cut off feeding to said electric pump.

5. The control device of an internal combustion engine according to claim 1, wherein said prescribed period is defined with a prescribed time, regardless of a number of ignition performance of said ignition device.

* * * * *